US005758394A

United States Patent [19]

Linck et al.

[11] Patent Number: 5,758,394

[45] Date of Patent: Jun. 2, 1998

[54] ROTARY NEEDLING PROCESS AND SUPPORT FOR MAKING NEEDLED FIBROUS STRUCTURES

[75] Inventors: John S. Linck; Edward Lee Morris, Jr., both of Pueblo, Colo.; Hannes Pum, Alberdorf, Australia

[73] Assignee: The B.F. Goodrich Company, Richfield, Ohio

[21] Appl. No.: 905,095

[22] Filed: Aug. 1, 1997

Related U.S. Application Data

[63] Continuation of Ser. No. 771,555, Dec. 20, 1996, abandoned.

[51] Int. Cl.[6] ..... B32B 5/06

[52] U.S. Cl. ..... 28/107

[58] Field of Search ..... 28/103, 104, 107, 28/108, 109, 110, 111, 112, 113, 114, 115

[56] References Cited

U.S. PATENT DOCUMENTS

| | | | |
|---|---|---|---|
| 3,829,939 | 8/1974 | Dilo | 28/4 R |
| 4,621,662 | 11/1986 | Olry | 138/129 |
| 4,651,393 | 3/1987 | Dilo et al. | 28/111 |
| 4,790,052 | 12/1988 | Olry | 28/110 |
| 4,955,123 | 9/1990 | Lawton et al. | 28/107 |
| 5,081,754 | 1/1992 | Lawton et al. | 29/419.1 |
| 5,113,568 | 5/1992 | Lawton et al. | 29/419.1 |
| 5,184,387 | 2/1993 | Lawton et al. | 29/419.1 |
| 5,217,770 | 6/1993 | Morris, Jr. et al. | 28/107 |
| 5,226,217 | 7/1993 | Olry et al. | 28/107 |
| 5,323,523 | 6/1994 | Lawton et al. | 29/419.1 |
| 5,388,320 | 2/1995 | Smith et al. | 29/419.1 |
| 5,417,138 | 5/1995 | Mottis et al. | 87/31 |
| 5,473,802 | 12/1995 | Dilo | 28/107 |
| 5,513,423 | 5/1996 | Jakob et al. | 28/107 |
| 5,546,880 | 8/1996 | Ronyak et al. | 112/475.01 |

FOREIGN PATENT DOCUMENTS

| | | |
|---|---|---|
| 2306416 | 8/1974 | Germany . |
| 2911762 | 9/1980 | Germany . |
| 321483 1A1 | 10/1983 | Germany . |

*Primary Examiner*—C. D. Crowder
*Assistant Examiner*—Larry D. Worrell, Jr.
*Attorney, Agent, or Firm*—Kevin L. Leffel

[57] ABSTRACT

A rotary needling process including a multitude of felting needles repeatedly driven into a fibrous structure disposed on a surface of a needle penetrable support as the support is rotated about an axis of rotation. The process according to the invention comprises the steps of removably fixing a needle penetrable sheet to a rotary needling support, the rotary needling support defining a face disposed beneath a multitude of felting needles and having a needle penetrable area, the needle penetrable sheet covering the face and being fixed to the rotary needling support outside the face; rotating the needle penetrable sheet about an axis of rotation; depositing at least a first fibrous layer on the needle penetrable sheet; cohering the first fibrous layer and the needle penetrable sheet by repeatedly driving the multitude of felting needles into the first fibrous layer and the needle penetrable sheet; and, removing the first fibrous layer and the needle penetrable sheet from the rotary needling support subsequent to the first fibrous layer and the needle penetrable sheet being cohered. According to a further aspect of the invention, a rotary needling support for use in the process is also provided.

23 Claims, 5 Drawing Sheets

ROTARY NEEDLING PROCESS AND SUPPORT FOR MAKING NEEDLED FIBROUS STRUCTURES

This application is a continuation of application Ser. No. 08/771,555, filed Dec. 20, 1996, now abandoned.

BACKGROUND

The invention relates to the field of producing fibrous structures by a needling process. More particularly, the invention relates to rotary needle processes in which a multitude of forked or barbed needles are repeatedly driven into a fibrous structure disposed on a bedplate as the fibrous structure is rotated about an axis of rotation.

Rotary needling processes and machinery are well known in the textile arts. According to one type of prior art process, a multitude of forked or barbed needles are repeatedly driven into a fibrous structure disposed on a planar surface of a needle penetrable support as the support is rotated about an axis of rotation perpendicular to the planar surface. Examples are described in U.S. Pat. Nos. 5,217,770 and 4,955,123, and German national application DE 2911762 A1. This particular type of rotary needling process may be employed to make circular and annular fibrous structures, and has been found to be quite useful for making aircraft brake disk preforms suitable for subsequent processing into composite aircraft brake disks, such subsequent processing including infiltration of a binding matrix according to various methods well known in the relevant art.

According to prior art techniques, the needle penetrable support comprises a needle penetrable medium (for example, plastic, elastomer, foamed plastic or elastomer, or brush bristles) that defines a planar surface upon which fibrous material is deposited as needling support is rotated about an axis of rotation perpendicular to the planar surface. Typically, the fibrous material first deposited on the planar surface is cohered with the needle penetrable medium in order to cause the fibrous material to move with the needle support as additional fibrous material is added until a cohered fibrous structure having a desired final thickness is produced. The fibrous structure is subsequently removed from the support by either peeling, prying, or cutting it from the needle penetrable medium. Peeling the fibrous structure from the needle penetrable medium is undesirable with certain thick fibrous structures, such as aircraft brake disk preforms, because it distorts and often damages the fibrous structure. If distortion and damage is of concern, then the fibrous structure is cut from the needle penetrable medium. However, the latter approach leaves residual fibrous material in the needle penetrable medium which must be removed before making another fibrous structure, which is tedious and time consuming.

In some processes of this type, a point in the process is reached wherein additional fibrous layers are being added and needled without driving the needles into the needle penetrable medium, i.e. without needling all the way through the fibrous material deposited on the support. Certain processes for making aircraft brake disk preforms employ this feature. A fibrous structure manufactured in such manner is prone to break free from the needle penetrable medium before the fibrous structure is completed. One solution to this problem is to increase the bond between the fibrous structure and the needle penetrable medium by increasing the amount of fiber transported into the needle penetrable medium. This solution is undesirable for two reasons: because it makes the fibrous structure even more difficult to remove, and because it leaves even more fiber in the needle penetrable medium for subsequent removal.

Therefore, an object of the invention is to provide a needling process and support wherein fibrous material deposited on the support is fixed to the support with sufficient strength to remain fixed through completion of the fibrous structure. A further object of the invention is to provide easy removal of the fibrous structure upon completion, with minimum residual of fibrous material in the needle penetrable medium.

SUMMARY OF THE INVENTION

According to an aspect of the invention, a rotary needling process is provided, comprising the steps of:

removably fixing a needle penetrable sheet to a rotary needling support, the rotary needling support defining a face disposed beneath a multitude of felting needles and having a needle penetrable area, the needle penetrable sheet covering the face and being fixed to the rotary needling support outside the face;

rotating the needle penetrable sheet about an axis of rotation;

depositing at least a first fibrous layer on the needle penetrable sheet;

cohering the first fibrous layer and the needle penetrable sheet by repeatedly driving the multitude of felting needles into the first fibrous layer and the needle penetrable sheet; and, removing the first fibrous layer and the needle penetrable sheet from the rotary needling support subsequent to the first fibrous layer and the needle penetrable sheet being cohered.

According to a further aspect of the invention, a rotary needling support is provided for use in a rotary needling process, comprising:

a bedplate defining a face having a needle penetrable area;

an outer base ring encircling the face, the outer base ring being rotatable around an axis of rotation; and, a needle penetrable sheet covering the face and attached to the outer base ring such that the needle penetrable sheet rotates with the outer base ring.

DETAILED DESCRIPTION OF THE INVENTION

Figure 2:
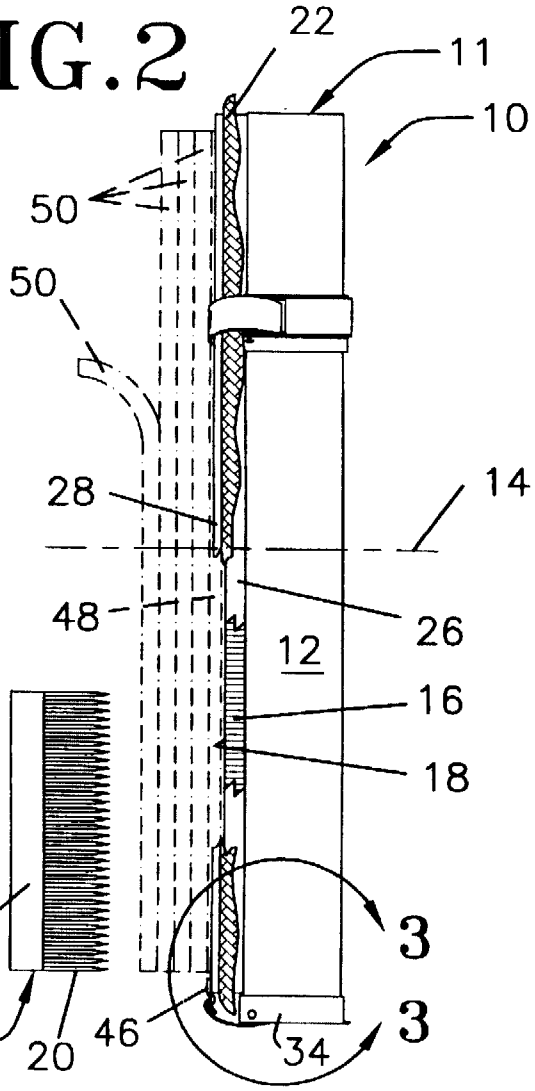
FIG. 2 presents a side view of the FIG. 1 rotary needling support, with portions broken away.
Figure 1:
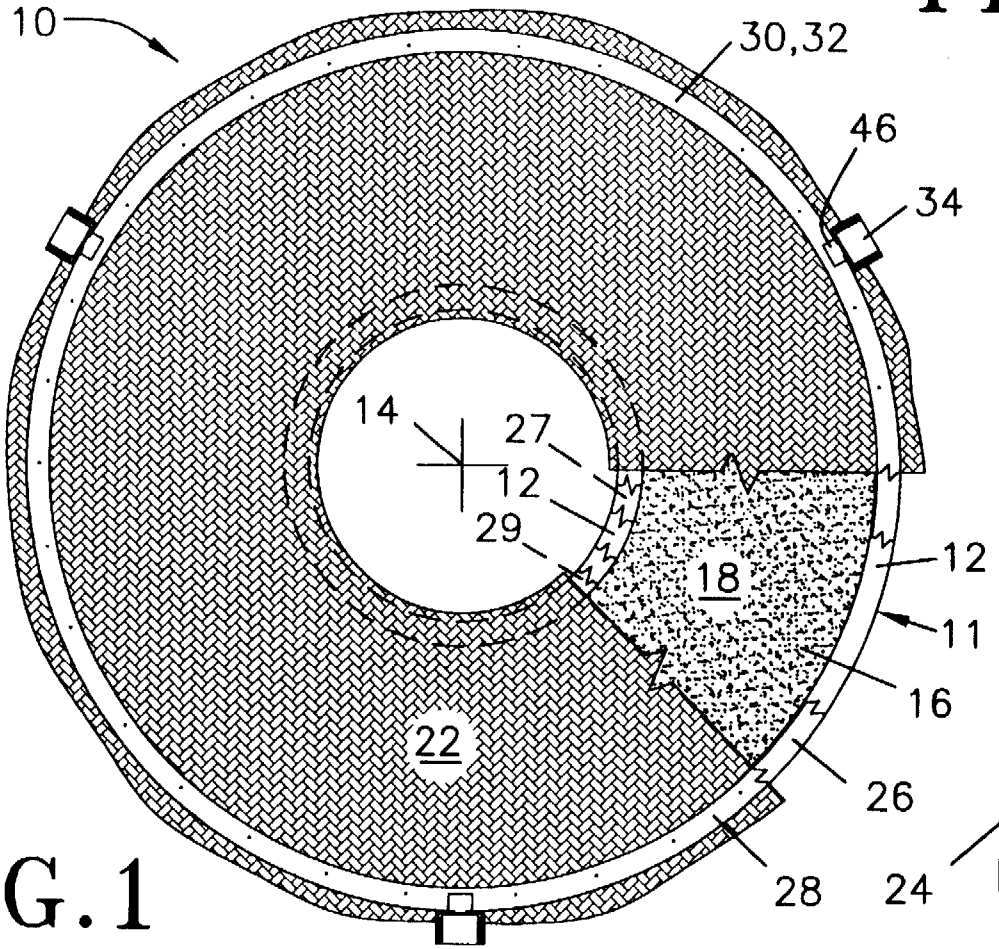
FIG. 1 presents a top view of a rotary needling support, according to an aspect of the invention, with portions broken away.

Various aspects of the invention are presented in FIGS. 1–6, which are not to scale, and wherein like components are numbered alike. Referring now to FIGS. 1 and 2, a rotary needling support 10 is provided, according to an aspect of the invention. The rotary needling support 10 comprises a bedplate 11 that defines a face 18 having a needle penetrable area, and an outer base ring 26 encircling the face 18, the outer base ring 26 being rotatable around an axis of rotation 14, preferably perpendicular to the face 18. The base ring 26 may be formed as an integral part of the bedplate 11, or as a separate piece. In the embodiment of FIGS. 1 and 2, the needle penetrable area is coextensive with the face 18, but the needle penetrable area may occupy only a portion of the face 18. A needle penetrable sheet 22 covers the face 18 and is attached to the outer base ring 26 such that the needle penetrable sheet 22 rotates beneath a needling head 54. The needling head 54 comprises a multitude of felting needles 20 mounted in a needle board 24, the felting needles 20 being repeatedly driven into the needle penetrable sheet 22 and the needle penetrable area of the face 18 during at least a portion of the rotary needle felting process, as the needle penetrable sheet 22 rotates beneath the needling head 54. As used herein, the term "felting needles" refers to forked or barbed needles that are repeatedly driven into a fibrous structure to increase entanglement and compaction of the fibrous structure, such process being very well known in the art. Suitable felting needles are available from Groz-Beckert, Germany, and Foster Needle Co., Inc., Wisconsin, U.S.A. The needle penetrable sheet 22 acts, in part, as a carrier upon which fibrous layers are deposited and cohered by the action of the multitude of felting needles 20. The felting needles 20 are forked or barbed, as is known in the art, which causes the felting needles 20 to transport fiber within the fibrous layers. The needling head may take various shapes depending on the desired needling action, but generally extends across the full width of the fibrous layers to be needled, the "width" being perpendicular to the direction the fibrous layers are passed beneath the needle head 54. Multiple needling heads may be employed, each head having a width corresponding to the width of the fibrous layers or less than the width of the fibrous layers. Likewise, the needling head 54 may cover just a portion of the circumference of the face 18 as shown in FIG. 1, or the entire circumference of the face 18. Any such variations are considered to fall within the purview of the invention.

Two embodiments for driving the needle penetrable sheet 22 are presented in FIGS. 1–6. In both embodiments, the needling head 54 is reciprocated in a manner well known in the art by a suitable mechanism. The needling support may be raised and lowered relative to the felting needles parallel to the axis of rotation by an appropriate mechanism, such as a powered jackscrew. The rotary needling support and needling head are attached to a frame, along with drive and control mechanisms. Rotary needling machinery and processes that may employ the rotary needling support according to the invention are known in the art, examples of which are described in U.S. Pat. Nos. 5,217,770 and 4,955,123, and German national patent application DE 2911762 A1. A detailed description of such machinery is not necessary here.

In the embodiment presented in FIGS. 1 and 2, the bedplate 11 comprises a base 12 rotatable about the axis of rotation 14 during the needling process, and a needle penetrable area beneath the multitude of felting needles 20. With bedplate 11, the needle penetrable area covers essentially all of face 18 since the entire face is passed beneath the multitude of felting needles 20. The needle penetrable area may be an array of holes (not shown) or concentric grooves (not shown) in the base 12 aligned with the felting needles 20, or a needle penetrable medium 16 may be attached to the base 12, with the latter being preferred since it eliminates the need to align the felting needles 20 with holes or grooves in the base 12. In this embodiment, the needle penetrable medium 16 superposes a portion of the base 12 and defines the face 18, which may be perpendicular to the axis of rotation 14. The face 18 may be planar or non-planar, such as concave or convex, depending on the particular needling process and the desired shape of the fibrous structure made by the process. The needle penetrable sheet 22 (shown with a portion broken away to expose the face 18) superposes the needle penetrable medium 16 and is removably fixed to the base 12 outside the face 18 in a manner that will be described in more detail. According to a preferred embodiment, the base 12, the needle penetrable medium 16, the face 18, and the needle penetrable sheet 22 are circular about the axis of rotation 14, and are more preferably annular about the axis of rotation 14. If the face 18 is annular, the needle penetrable sheet 22 may be attached outside the face 18 adjacent the outside diameter of the face 18, adjacent the inside diameter of the face 18, or both. Essentially the entire face 18 is passed beneath the needle board 24 and is subjected to penetration by the multitude of felting needles 20 during at least a portion of the needling process, and normally occurs at the beginning of the process.

A first fibrous layer 48 and one or more additional fibrous layers 50 are superposed over the needle penetrable medium 16 and the needle penetrable sheet 22, and subjected to one or more needling passes, as will be described in more detail. The fibrous layers 48 and 50 may take various forms. For making disks or annuli, the fibrous layers may be shaped as sectors of a disk or annulus, or the fibrous layers may be formed as a helical tape. Examples are provided in U.S. Pat. Nos. 5,546,880, 5,417,138, 5,217,770 and 4,955,123. The fibrous layers may comprise many types of fibers, including carbon and ceramic fibers, and precursors of carbon and ceramic fibers, and mixtures of these. Polyacrylonitrile (PAN) fiber, oxidized polyacrylonitrile fiber (OPF) are examples of carbon fiber precursors. The individual fibrous layers 48 and 50 may be formed, without limitation, from tows, yarns, woven and non-woven fabrics, knit fabrics and felts. As used herein the term "tow" is used to refer to a strand of continuous filaments. As used herein the term "yarn" is used to refer to a continuous strand of continuous or staple fibers or blends of these. Thus, various forms of continuous or discontinuous fiber (staple fiber) may be employed to form the fibrous layers 48 and 50.

Figure 3:
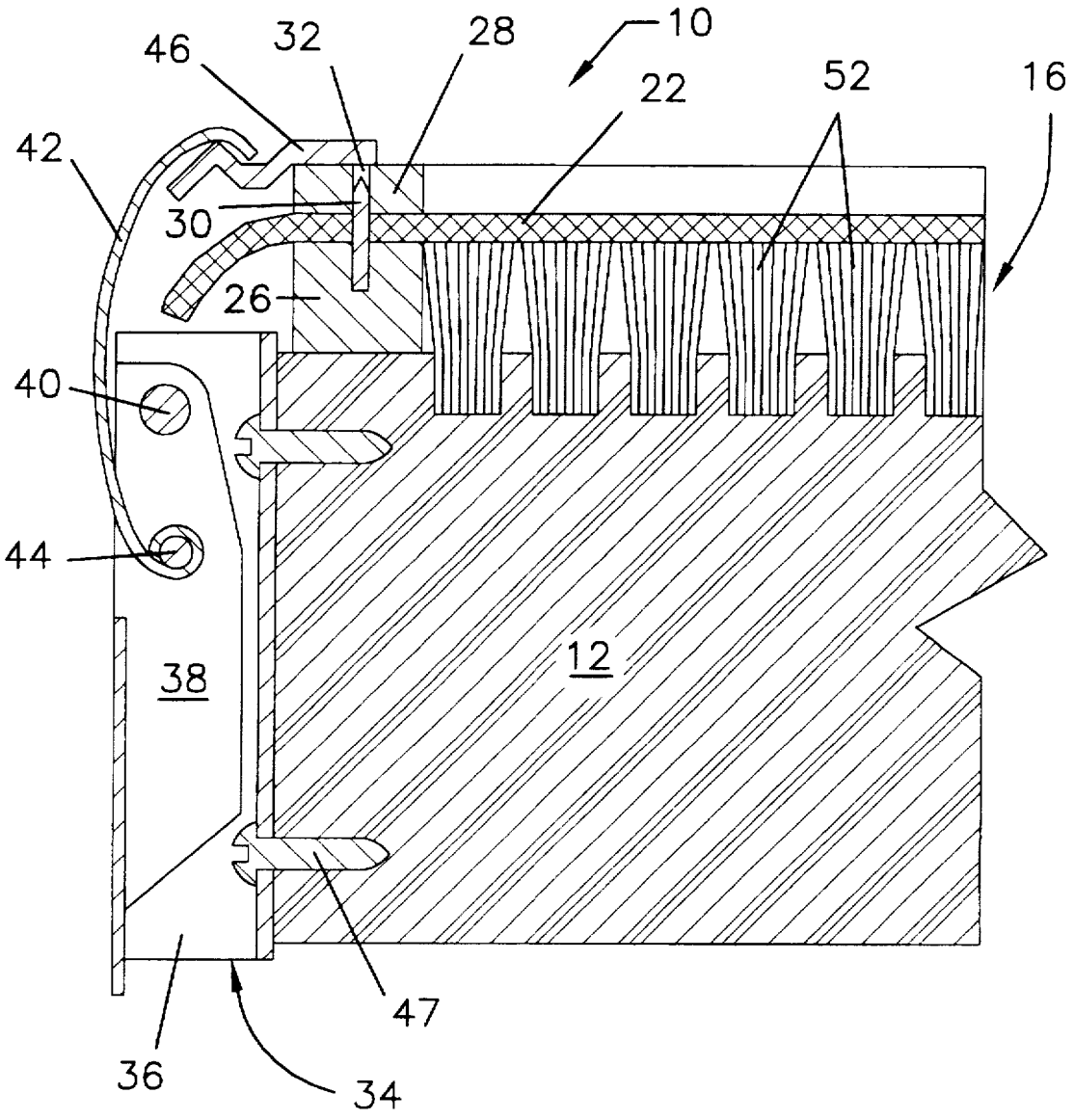
FIG. 3 presents a side cross-sectional view of the area indicated as 3—3 on FIG. 2.

In the example presented in FIGS. 1 and 2, the needle penetrable sheet 22 is clamped to the base 12. This is preferably accomplished by providing an outer base ring 26 encircling the surface 18 and fixed to the base 12. The needle penetrable sheet 22 superposes the outer base ring 26. An outer retaining ring 28 superposes the outer base ring 26 and clamps the needle penetrable sheet 22 therebetween. The outer retaining ring 28 and outer base ring 26 grips the needle penetrable sheet 22. As best shown in FIG. 3, wherein corresponding components presented in FIGS. 1 and 2 are numbered accordingly, the outer base ring 26 may comprise a plurality of pointed pins 30 protruding from the outer base ring 26 parallel to the axis of rotation 14. The needle penetrable sheet 22 superposes the outer base ring 26 and is impaled by the pins 30. The outer retaining ring 28 has a plurality of mating holes 32 that register with and receive the pointed pins 30 when the outer retaining ring 28 is placed over the outer base ring 26. A multitude of pins 30 and holes 32 are preferably provided, evenly spaced around the circumference of the rings 26 and 28. Other techniques for gripping the needle penetrable sheet 22 are contemplated in the practice of the invention, for example providing a serrated face on the outer retaining ring 28 and a rubber surface on the outer base ring 26, the needle penetrable sheet 22 being clamped between the serrated face and the rubber surface. The outer base ring 26 may be removably attached to the base 12 by a plurality of threaded fasteners (not shown) that pass through a plurality of holes in the outer base ring 26 and engage mating threaded holes (not shown) in the base 12, or other suitable means. Various means of gripping the needle penetrable sheet 22 outside the face 18 are apparent to persons skilled in the art in light of the disclosure provided herein, any of which are considered to fall within the purview of the invention.

An inner base ring 27 (shown in dashed lines) and inner retaining ring 29 (shown in dashed lines), both shown with a portion broken away, may be employed to attach the needle penetrable sheet 22 to the base 12 adjacent the inside diameter of the face 18, the inner base ring 27 and inner retaining ring 29 having the same features described herein in relation to outer base ring 26 and outer retaining ring 28. In such embodiment, the face 18 encircles the inner retaining ring 29 and inner base ring 27. Attaching the needle penetrable sheet 22 adjacent the outside diameter is preferred. The base 12 is configured to be driven with the outer base ring 26, both components being rotated about the axis of rotation 14 by suitable drive means (not shown), such drive means being known in the art for rotary needling processes. Driving the base 12 and the outer base ring 26 together is preferred because the needle penetrable sheet 22 is driven by frictional engagement with the base 12 as well as mechanical engagement with the outer base ring 26, which reduces stress on the sheet 22 where it attaches to the ring 26.

The needle penetrable medium 16 is preferably attached to the base, and may be permanently fixed to the base 12. According to a preferred embodiment, the needle penetrable medium 16 comprises brush bristles 52 fixed to the base 12, as shown in FIG. 3. The needle penetrable medium 16 may also comprise a foamed elastomer and/or a foamed plastic. Nylon (polyamide) brush bristles 52 are preferred in the practice of the invention since they are more durable and reusable. Examples of needle penetrable mediums comprised of brush bristles, pins, or needles are described in German national patent applications DE 2911762 A1 and DE 3214831 A1, German Offenlegungsschrift 2 306 416, and U.S. Pat. Nos. 3,829,939, and 4,651,393, any of which are suitable in the practice of the invention. The base 12 is preferably rigid, and may be formed from suitable materials, such as metals, plastics, and fiber reinforced plastics. The outer base ring 26, outer retaining ring 28, and pins 30 are preferably formed from a metal, such as steel. The needle penetrable sheet may be a fibrous sheet, and is preferably a woven fibrous sheet. A preferred embodiment of the invention for making aircraft brake disk preforms from oxidized polyacrylonitrile fiber (OPF) employs a 14.25 ounce per square yard cotton chafer for the needle penetrable sheet 22 having 23 warp ends per inch and 23 picks per inch, and a cotton count of warp and filling of 2.5–2.75, available as Style G1250 from Eastbank Textiles/Eastbank Trading Co., Macon, Ga., U.S.A., and manufactured by Walton Monroe Mills Inc., Monroe, Ga., U.S.A. The cotton chafer works quite well in the practice of the invention because it acts as a good vehicle for bonding to fibrous layers 48 and 50 by receiving fiber transported from one or more of those layers, and has good strength for rotation with resistance to tearing. However, the use of other types of fibrous layers having similar characteristics is contemplated, including non-woven and knit materials, any of which are considered to fall within the purview of the invention.

According to an aspect of the invention, at least one needle penetrable sheet 22 is provided, and at least one additional needle penetrable sheet may be provided covering the face 18 and fixed to the rotary needling support 10 outside the face 18. Thus, two, three, or more needle penetrable sheets 22 may be provided superposed over each other and attached to the base 12 outside the face 18. Employing superposed needle penetrable sheets 22 is useful if needling is too aggressive and damages a single needle penetrable sheet 22. It has been found that superposing two or more sheets provides a support structure that can withstand more aggressive needling. Alternatively, the weight of the needle penetrable sheet may be increased rather than providing multiple superposed sheets. However, providing two or more needle penetrable sheets is more expedient because only one weight of material need be specified and maintained in stock.

The needle penetrable sheet 22 may be clamped between the outer base ring 26 and outer retaining ring 28 by various means, including threaded fasteners and various clamping devices known in the mechanical arts such as spring loaded clamps, screw actuated clamps, pneumatic clamps, and hydraulic clamps. As presented in FIGS. 1 and 2, a certain embodiment utilizes a plurality of draw hasps 34 attached to the base 12. Referring again to FIG. 3, the draw hasps draw the outer retaining ring 28 toward the outer base ring 26 thereby clamping the needle penetrable sheet 22 therebetween. Draw hasp 34 comprises a hasp body 36, a hasp lever 38 pivotally attached to the hasp body 36 by a hasp pin 40, and a hasp clamp 42 pivotally attached to the hasp lever 38 by a clamp pin 44. Pivoting the hasp lever 38 about the hasp pin 40 clockwise moves the clamp pin 44 clockwise, which moves the hasp clamp 42 upward and releases the outer retaining ring 28. The outer retaining ring 28 is clamped by pivoting the hasp lever 38 clockwise, which moves the hasp clamp 42 downward. A clamp tab 46 is preferably attached to the outer retaining ring 28 which cooperates with and engages the end of the hasp claim 42. The clamp tab 46 may be attached to the outer retaining ring 28 by suitable means, including screws, rivets, and welds. The draw hasp 36 may be attached to the base 12 by suitable means, including screws, rivets, and welds. Screws 47 are employed in the example presented in FIG. 3.

Figure 5:
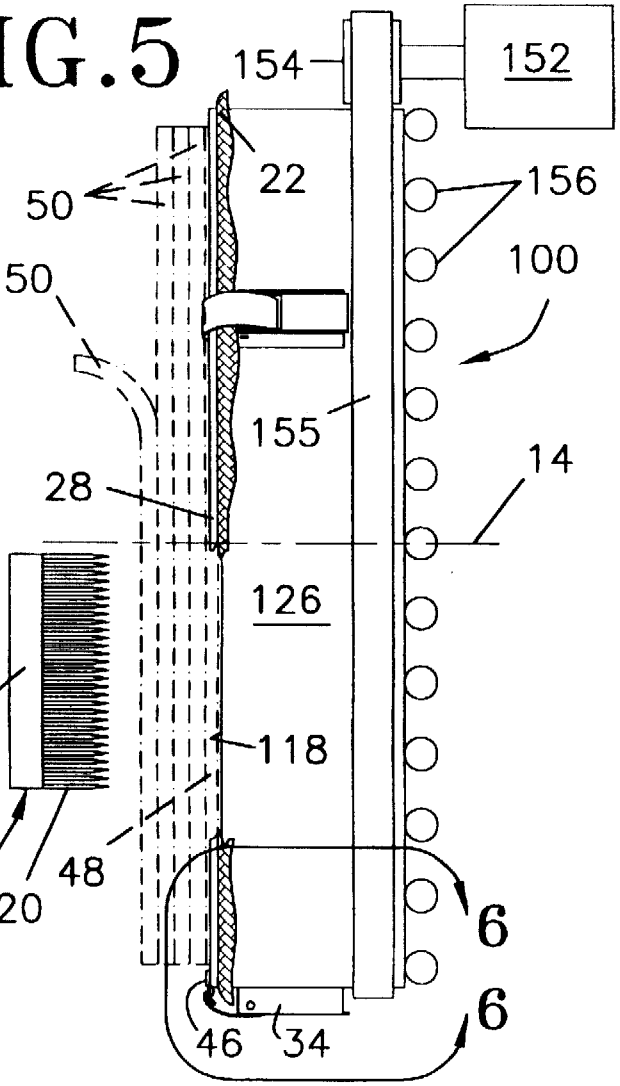
FIG. 5 presents a side view of the FIG. 4 rotary needling support, with portions broken away.
Figure 4:
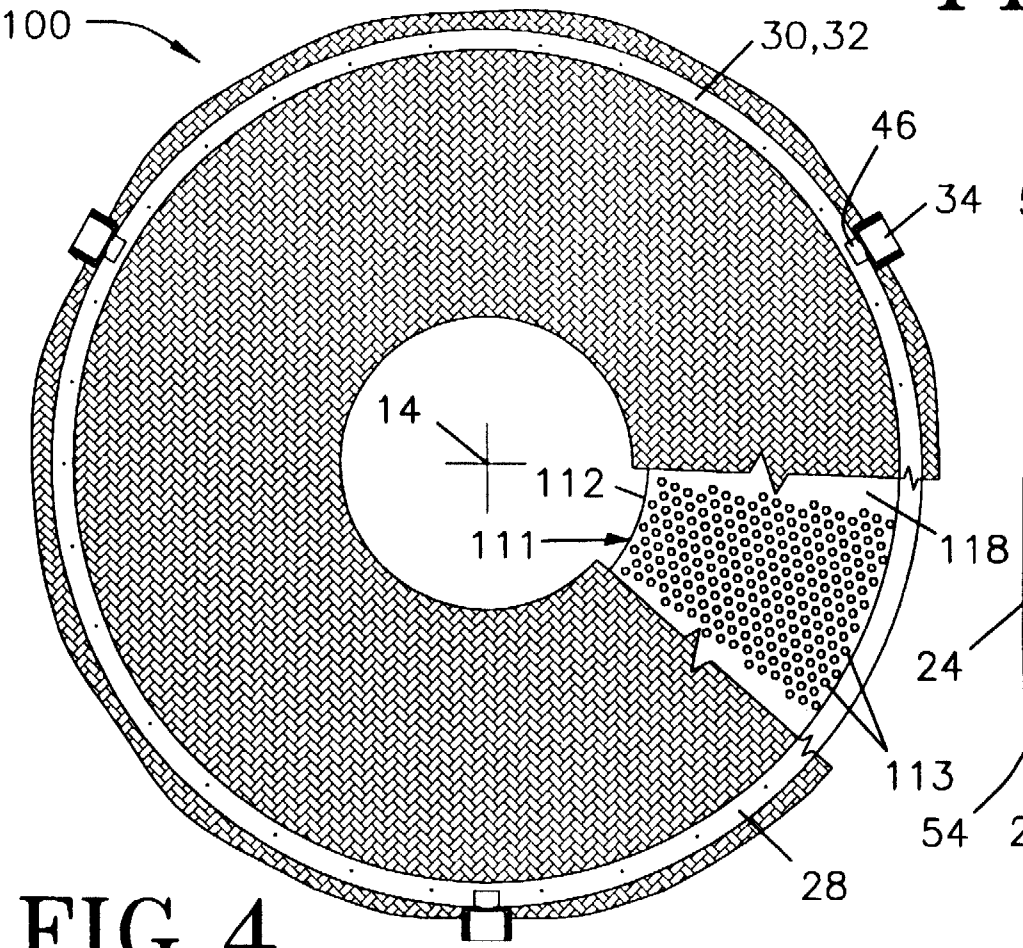
FIG. 4 presents a top view of a rotary needling support, according to a further aspect of the invention, with portions broken away.
Figure 6:
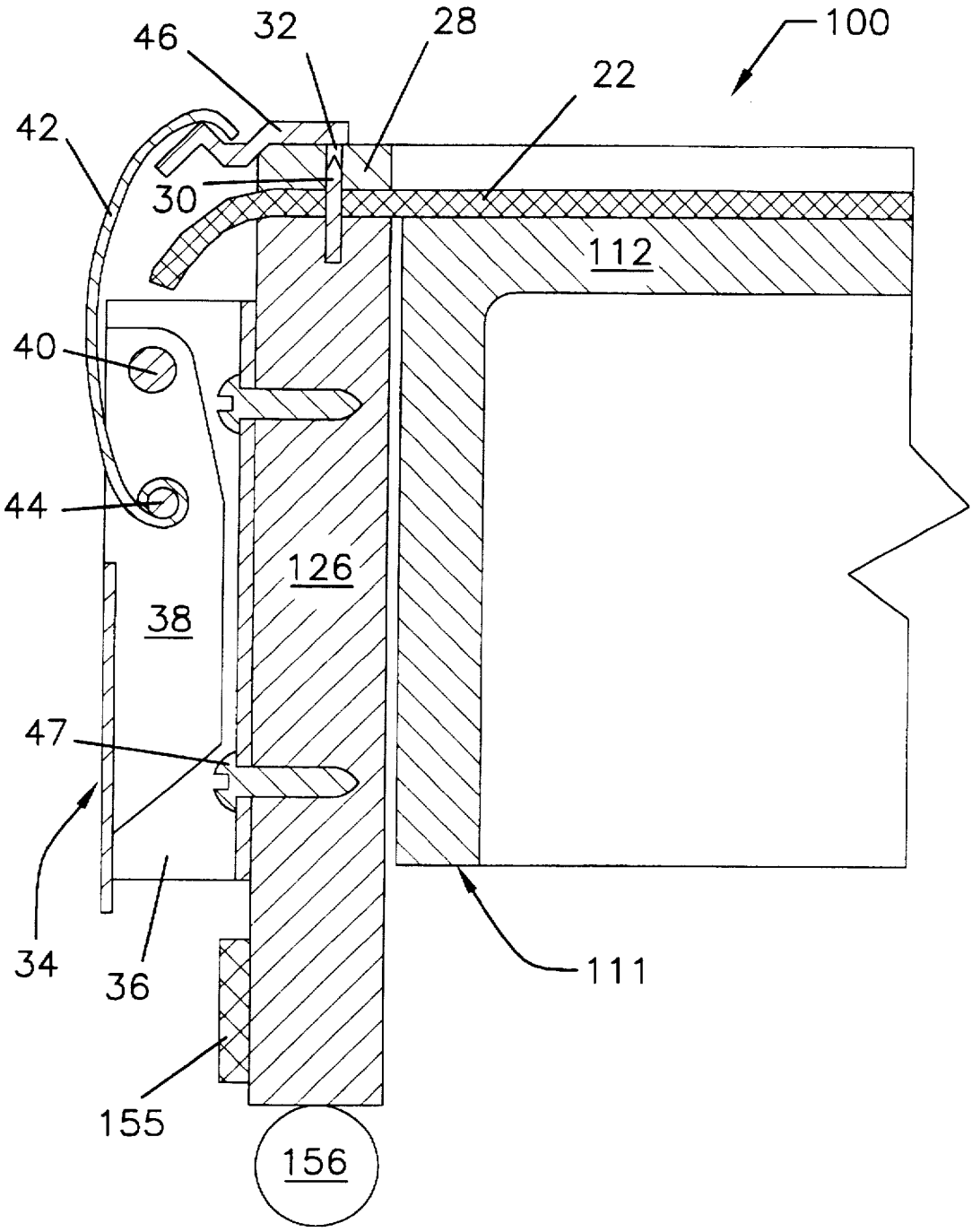
FIG. 6 presents a side cross-sectional view of the area indicated as 6—6 on FIG. 5.

Referring now to FIGS. 4–6, a rotary needling support 100 according to another aspect of the invention is presented. The rotary needling support 100 is similar to the rotary needling support 10 of FIGS. 1–2, and like components in the two embodiments are numbered alike. Rotary needling support 100 comprises a bedplate 111 having a base 112 that defines a face 118 having a needle penetrable area being an array of holes 113 in the base 112. In this embodiment, the needle penetrable area corresponds to the area penetrated by the multitude of felting needles, which may be all or part of the face 118 depending on the shape of the needling head 54. A multitude of felting needles 20 are mounted in a needle board 24 disposed over the array of holes 113, with each hole being aligned with a respective needle 20. The needle penetrable area may also be comprised of an array of concentric grooves (not shown), or a needle penetrable medium such as a brush may be employed to define all of face 118, or just the portion beneath the multitude of felting needles 20. An outer base ring 126 encircles the face 118 and is free to rotate relative to the bedplate 111. The needle penetrable sheet 22 covers the face 118 and is attached to the outer base ring 126 in a manner previously described in relation to FIGS. 1–3. However, in the embodiment depicted in FIGS. 4–6, the bedplate 111 is fixed against rotation relative to the multitude of felting needles 20, and the needle penetrable sheet 22 is rotated by rotating the outer base ring 126. The needle penetrable sheet 22 slides over the face 118, which remains stationary, and the outer base ring 126 forces the needle penetrable sheet 22 to rotate with the outer base ring 126. In this embodiment, a stronger needle penetrable sheet 22 may be employed in order to prevent the sheet from tearing away from the outer base ring 126 such as, for example, a heavier weight cotton chafer. An inner base ring may also be provided similar in construction and operation to outer base ring 126, the inner base ring being encircled by the face 118. The inner base ring may be driven with the outer base ring 126.

The outer base ring 126 (and/or inner base ring) is supported, such as by bearings 156, and is forced to rotate by a motor 152, which is mechanically engaged to the outer base ring 126 by a suitable mechanism. According to a preferred embodiment, a pulley 154 is attached to the motor shaft, and the outer base ring 126 (and/or inner base ring) is driven by a belt 155. Alternatively, a pinion may engage the inside or the outside of outer base ring 126 (and/or inner base ring). A ring gear may be provided on the outer base ring (and/or inner base ring) to engage the pinion. Other drive mechanisms are evident to persons skilled in the art of needling machinery, any of which are considered to fall within the purview of the invention.

Figure 7:
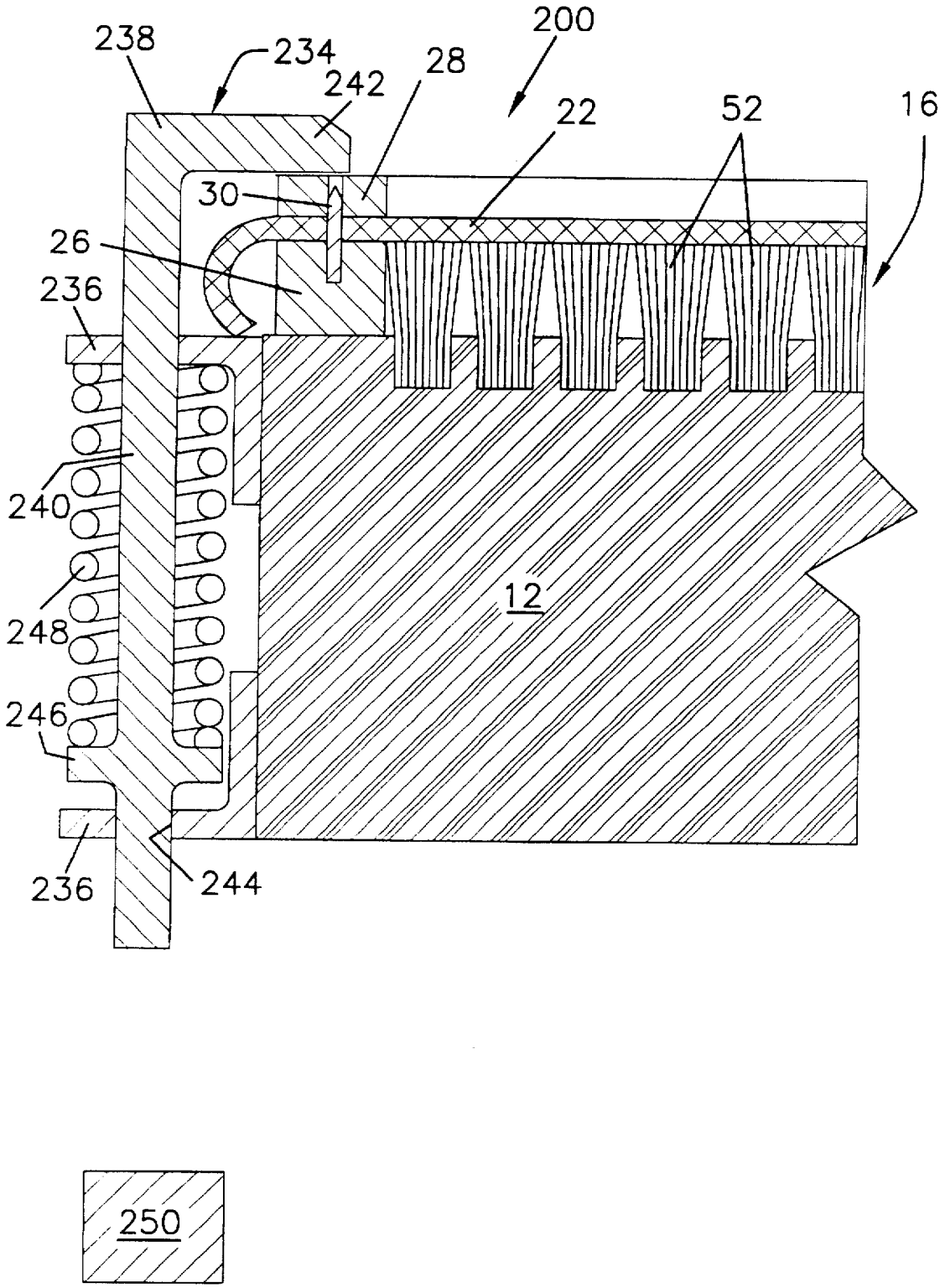
FIG. 7 presents a side cross-sectional view of a portion of a rotary needling support according to a further aspect of the invention.

Referring now to FIG. 7, a cross-sectional view of a portion of a rotary needling support 200 is presented according to a further aspect of the invention. Needling support 200 is very similar to needling support 10, except that needling support 200 comprises a plurality of spring-loaded clamps 234 in place of the draw hasps 34. The spring loaded clamp 234 comprises a pair of guide brackets 236, and a clamp bar 238 received within the guide brackets 236. The clamp bar 238 comprises a shaft portion 240 and a finger portion 242. Each guide bracket 236 has a hole 244 in alignment with each other, and the shaft portion 240 is received in the holes 244 in a manner such that the shaft portion 240 may slide (translate) vertically within the guide brackets 236. The shaft 236 has a spring stop 246, and a spring 248 is disposed in compression between the stop 246 and the upper guide bracket 236. The spring 248 pulls the shaft portion 240 down, which drives the finger portion 242 into the outer retaining ring 28, thereby providing a clamping force that clamps the needle penetrable sheet 22 between the outer retaining ring 28 and the outer base ring 26. The outer retaining ring 28 is released by lowering the needle penetrable support 200. As the support 200 is lowered, the end of the shaft portion 240 contacts a release stop 250, which stops the clamp bar 238 while the support 200 continues to lower, thereby causing the outer retaining ring 28 to move away from the finger portion 242. The release stop 250 is fixed to the frame (not shown) of the needling machine. With the needling support 200 lowered a predetermined distance, the clamps 234 release the outer retaining ring 28 and permit its installation or removal. The spring loaded clamp 234 be may employed with any embodiment of the invention described herein.

A rotary needling process is also provided, according to a further aspect of the invention. Referring again to FIG. 2, the process comprises the steps of removably fixing a needle penetrable sheet 22 to a rotary needling support 10, the rotary needling support 10 defining a face 18 disposed beneath a multitude of felting needles 20 and having a needle penetrable area, the needle penetrable sheet 22 covering the face and being fixed to the rotary needling support 10 outside the face 18; rotating the needle penetrable sheet 22 about an axis of rotation; depositing at least a first fibrous layer 48 on the needle penetrable sheet 22; cohering the first fibrous layer 48 and the needle penetrable sheet 22 by repeatedly driving the multitude of felting needles 20 into the first fibrous layer 48 and the needle penetrable sheet 22; and, removing the first fibrous layer 48 and the needle penetrable sheet from the rotary needling support subsequent to the first fibrous layer 48 and the needle penetrable sheet 22 being cohered. Though described in relation to the needling support 10 of FIGS. 1 and 2, the process may also be employed with the needling support 100 of FIGS. 4 and 5, and the needling support 200 of FIG. 7.

Still referring to FIG. 2, according to a further aspect of the invention, the process comprises the steps of superposing the needle penetrable sheet 22 over the needle penetrable medium 16 attached to the base 12, the needle penetrable medium 16 defining the planar face 18; removably fixing the needle penetrable sheet 22 to the base 12 outside the planar face 18; rotating the base 12 about the axis of rotation 14 perpendicular to the planar face 18; depositing at least a first fibrous layer 48 on the needle penetrable sheet 22; cohering the first fibrous layer 48 and the needle penetrable sheet 22 by repeatedly driving the multitude of felting needles 20 into the first fibrous layer 48 and the needle penetrable sheet 22; and removing the first fibrous layer 48 and the needle penetrable sheet 22 from the needle penetrable medium 16 subsequent the first fibrous layer 48 and the needle penetrable sheet 22 being cohered. The various features previously described in relation to FIGS. 1–7 may be employed in this process.

According to a preferred embodiment, the multitude of felting needles 20 penetrate the needle penetrable medium 16 during at least a portion of the step of cohering the first fibrous layer 48 and the needle penetrable sheet 22, without cohering the needle penetrable sheet 22 and the needle penetrable medium 16 or, stated differently, without adhering the needle penetrable sheet 22 to the face 18. A fibrous structure manufactured by employing this step is easily removable from the bed plate 11.

If a needle penetrable area comprising an array of holes 113 or an array of concentric grooves (not shown) is employed, fiber transported through the needle penetrable sheet 22 into the holes 113 or grooves (not shown) does not cause the needle penetrable sheet 22 to adhere to the face 18 because the fiber easily pulls from the holes or grooves. If a brush 52 is employed as the needle penetrable medium 16, the previously described cotton chafer needle penetrable sheet 22 greatly inhibits transport of fiber into the brush 52. Modulating needling parameters to reduce transport generally is not necessary because the cotton chafer acts as an effective barrier against fiber transport into the brush. Little, if any, fiber remains in the brush 52 after the fibrous sheet 22 is removed. The finish of the surface 18 of the brush 52 does not appear to affect the tendency of the needle penetrable sheet 22 to adhere to the brush 52.

According to a further preferred embodiment, the process further comprises the steps of depositing a multitude of additional fibrous layers 50 on the first fibrous layer 48, and cohering the first fibrous layer 48 and the multitude of additional fibrous layers 50 by repeatedly driving the multitude of felting needles 20 into the first fibrous layer 48 and the multitude of additional fibrous layers 50. The latter step may be employed without driving the multitude of felting needles 20 into the first fibrous layer 48, or all the way through the multitude of additional fibrous layers 50, while cohering at least some of the additional fibrous layers 50. Generally, these layers are the middle and/or top additional fibrous layers 50, which is typical for relatively thick fibrous structures, such as aircraft brake disks. In such a process, the multitude of felting needles 20 are driven into the needle penetrable medium 16 while cohering at least some of the fibrous layers 48 and 50 (typically at the beginning of the process), and the multitude of felting needles are not driven into the needle penetrable medium while cohering at least some of the fibrous layers 50 (typically at the middle and/or end of the process). Each of the layers 48 and 50 may be superposed and individually needled to one or more previous layers, or more than one layer may be superposed over one or more previous layers before being subjected to a needling pass. The fibrous layers 50 may, without limitation, be comprised of individual fibrous annuli, layers of sectors of annuli placed in side-by-side contiguous relationship, and/or helical fibrous strips (braided, woven, or knitted). The layers are preferably comprised of oxidized polyacrylonitrile fiber (OPF) for manufacture of aircraft brake disk preforms, although other materials may be employed depending on the desired final properties or the intended use of the final fibrous structure, such materials including polyacrylonitrile fiber (PAN), carbon fibers, graphite fibers, ceramic fibers, precursors of carbon fibers and precursors of ceramic fibers, and mixtures of these.

According to a further aspect of the invention, a process suitable for making thick annular fibrous structures, such as composite aircraft brake disk preforms, is provided, comprising the steps of (a) superposing a fibrous sheet 22 over a needle penetrable medium 16 attached to a base 12, the needle penetrable medium 16 defining a planar face 18 and comprising a multitude of brush bristles; (b) removably fixing the fibrous sheet 22 to the base outside the planar face 18 by impaling the fibrous sheet 22 on a plurality of pins 30 fixed to the base 12 outside the planar surface 18 and clamping the fibrous sheet 22 to the base 16; (c) rotating the base 16 about an axis of rotation 14 perpendicular to the planar face 18; (d) depositing at least a first fibrous layer 48 on the fibrous sheet 22; (e) cohering the first fibrous layer 48 and the fibrous sheet 22 by repeatedly driving the multitude of felting needles 20 into the first fibrous layer 48 and the fibrous sheet 22; (f) depositing a multitude of additional fibrous layers 50 on the first fibrous layer 48 one or more layers at a time; cohering at least one of the additional fibrous layers 50 and the first fibrous layer 48 by repeatedly driving the multitude of felting needles into the first fibrous layer 48 the additional fibrous layer 50; (g) cohering the multitude of additional fibrous layers 50 by repeatedly driving the multitude of felting needles 20 into the multitude of additional fibrous layers 50, the multitude of additional fibrous layers 50 being cohered one or more layers at a time, and wherein the multitude of felting needles 20 are not driven into the needle penetrable medium 16 while cohering at least some of the multitude of additional fibrous layers 50; (h) and removing the fibrous sheet 22, the first fibrous layer 48, and the multitude of additional fibrous layers 50 from the needle penetrable medium 16 after they are cohered.

Many variations are evident to those persons skilled in the art, in light of the disclosure provided herein, any of which are considered to fall within the scope of the invention, as defined by following claims.

We claim:

1. A rotary needling process, comprising the steps of:

removably fixing at least one needle penetrable sheet to a rotary needling support, said rotary needling support defining a face disposed beneath a multitude of felting needles and having a needle penetrable area, said needle penetrable sheet covering said face and being fixed to said rotary needling support outside said face;

rotating said needle penetrable sheet about an axis of rotation;

depositing at least a first fibrous layer on said needle penetrable sheet;

cohering said first fibrous layer and said needle penetrable sheet by repeatedly driving said multitude of felting needles into said first fibrous layer and said needle penetrable sheet; and, removing said first fibrous layer and said needle penetrable sheet from said rotary needling support subsequent to said first fibrous layer and said needle penetrable sheet being cohered.

2. The process of claim 1, wherein said needle penetrable sheet does not adhere to said face.

3. The process of claim 1, further comprising the steps of:

depositing a multitude of additional fibrous layers on said first fibrous layer; and, cohering said first fibrous layer and said multitude of additional fibrous layers by repeatedly driving said multitude of felting needles into said first fibrous layer and said multitude of additional fibrous layers.

4. The process of claim 1, wherein said rotary needling support comprises a base, and a needle penetrable medium attached to said base that defines said face.

5. The process of claim 1, wherein said rotary needling support comprises a base that defines said face and an outer base ring encircling said face, said needle penetrable sheet being attached to said outer base ring, and wherein said needle penetrable sheet and said base are rotated with said outer base ring.

6. The process of claim 1, wherein said rotary needling support comprises a base that defines said face and an inner base ring encircled by said face, said needle penetrable sheet being attached to said inner base ring, and wherein said needle penetrable sheet and said base are rotated with said inner base ring.

7. The process of claim 1, wherein:

said rotary needling support comprises a base that defines said face and an outer base ring encircling said face, said needle penetrable sheet being attached to said outer base ring; and, wherein said rotary needling support comprises a base that defines said face and an inner base ring encircled by said face, said needle penetrable sheet being attached to said inner base ring, and wherein said needle penetrable sheet and said base are rotated with said inner base ring and said outer base ring.

8. The process of claim 1, wherein said rotary needling support comprises a base that defines said face and an outer base ring encircling said face, said needle penetrable sheet being attached to said outer base ring, and wherein said needle penetrable sheet is rotated by rotating said outer base ring, said base being fixed against rotation relative to said multitude of felting needles.

9. The process of claim 1, wherein said rotary needling support comprises a base that defines said face and an inner base ring encircled by said face, said needle penetrable sheet being attached to said inner base ring, and wherein said needle penetrable sheet is rotated by rotating said inner base ring, said base being fixed against rotation relative to said multitude of felting needles.

10. The process of claim 1, wherein:

said rotary needling support comprises a base that defines said face and an outer base ring encircling said face, said needle penetrable sheet being attached to said outer base ring; and, said rotary needling support comprises a base that defines said face and an inner base ring encircled by said face, said needle penetrable sheet being attached to said inner base ring, and wherein said needle penetrable sheet is rotated by rotating said inner base ring and said outer base ring, said base being fixed against rotation relative to said multitude of felting needles.

11. The process of claim 1, wherein said axis of rotation is perpendicular to said face.

12. The process of claim 1, further comprising the step of removably fixing at least one additional needle penetrable sheet to said rotary needling support covering said face and being fixed to said rotary needling support outside said face.

13. A rotary needling process, comprising the steps of:

superposing a needle penetrable sheet over a needle penetrable medium attached to a base, said needle penetrable medium defining a planar face disposed beneath a multitude of felting needles;

removably fixing said needle penetrable sheet to said base outside said planar face;

rotating said base about an axis of rotation perpendicular to said planar face;

depositing at least a first fibrous layer on said needle penetrable sheet;

cohering said first fibrous layer and said needle penetrable sheet by repeatedly driving said multitude of felting needles into said first fibrous layer and said needle penetrable sheet; and, removing said first fibrous layer and said needle penetrable sheet from said needle penetrable medium subsequent to said first fibrous layer and said needle penetrable sheet being cohered.

14. The process of claim 13, wherein said multitude of felting needles penetrate said needle penetrable medium during at least a portion of said step of cohering said first fibrous layer and said needle penetrable sheet, without cohering said needle penetrable sheet and said needle penetrable medium.

15. The process of claim 13, further comprising the steps of:

depositing a multitude of additional fibrous layers on said first fibrous layer; and, cohering said first fibrous layer and said multitude of additional fibrous layers by repeatedly driving said multitude of felting needles into said first fibrous layer and said multitude of additional fibrous layers.

16. The process of claim 13, further comprising the steps of:

superposing a multitude of additional fibrous layers on said first fibrous layer; and, cohering said first fibrous layer and said multitude of additional fibrous layers by repeatedly driving said multitude of felting needles into said first fibrous layer and said multitude of additional fibrous layers, without driving said multitude of felting needles all the way through said multitude of additional fibrous layers while cohering at least some of said additional fibrous layers.

17. The process of claim 13, wherein said step of removably fixing said needle penetrable sheet to said base comprises the step of clamping said needle penetrable sheet to said base.

18. The process of claim 13, wherein said needle penetrable medium is permanently fixed to said base.

19. The process of claim 13, wherein said needle penetrable medium comprises brush bristles permanently fixed to said base.

20. The process of claim 13, wherein said needle penetrable sheet is a fibrous sheet.

21. The process of claim 13, wherein said step of removably fixing said needle penetrable sheet to said base comprises the step of impaling said needle penetrable sheet on a plurality of pins fixed to said base outside said planar surface.

22. The process of claim 13, further comprising the step of removably fixing at least one additional needle penetrable sheet to said rotary needling support covering said face and being fixed to said rotary needling support outside said face.

23. A rotary needling process, comprising the steps of:

superposing a fibrous sheet over a needle penetrable medium attached to a base, said needle penetrable medium defining a planar face and comprising a multitude of brush bristles;

removably fixing said fibrous sheet to said base outside said planar face by impaling said fibrous sheet on a plurality of pins fixed to said base outside said planar surface and clamping said fibrous sheet to said base;

rotating said base about an axis of rotation perpendicular to said planar face;

depositing at least a first fibrous layer on said fibrous sheet;

cohering said first fibrous layer and said fibrous sheet by repeatedly driving said multitude of felting needles into said first fibrous layer and said fibrous sheet;

depositing a multitude of additional fibrous layers on said first fibrous layer one or more layers at a time;

cohering at least one of said additional fibrous layers and said first fibrous layer by repeatedly driving said multitude of felting needles into said first fibrous layer said at least one additional fibrous layer;

cohering said multitude of additional fibrous layers by repeatedly driving said multitude of felting needles into said multitude of additional fibrous layers, said multitude of additional fibrous layers being cohered one or more layers at a time, and wherein said multitude of felting needles are not driven into said needle penetrable medium while cohering at least some of said multitude of additional fibrous layers; and, removing said fibrous sheet, said first fibrous layer, and said multitude of additional fibrous layers from said needle penetrable medium after they are cohered.

* * * * *